United States Patent [19]

Blanchet-Fincher et al.

[11] Patent Number: 4,818,660

[45] Date of Patent: Apr. 4, 1989

[54] PHOTOHARDENABLE ELECTROSTATIC MASTER HAVING IMPROVED BACKTRANSFER AND CHARGE DECAY

[75] Inventors: Graciela B. Blanchet-Fincher; Curtis R. Fincher, Jr., both of Wilmington; Lawrence K.-F. Cheung, Hockessin; Rolf Dessauer, Greenville; Catharine E. Looney, Centreville, all of Del.

[73] Assignee: E. I. Du Pont De Nemours and Company, Wilmington, Del.

[21] Appl. No.: 117,189

[22] Filed: Nov. 4, 1987

[51] Int. Cl.[4] ..... G03G 5/026

[52] U.S. Cl. ..... 430/281; 430/283; 430/287; 430/915

[58] Field of Search ..... 430/281, 322, 394, 327, 430/328, 287, 915, 283

[56] References Cited

U.S. PATENT DOCUMENTS

| | | | |
|---|---|---|---|
| 3,286,025 | 11/1966 | Ingersoll | 178/6.6 |
| 4,050,941 | 9/1977 | Pazos | 430/913 |
| 4,668,607 | 5/1987 | Wojcik | 430/281 |

FOREIGN PATENT DOCUMENTS 0243934 11/1987 European Pat. Off. .

*Primary Examiner*—John L. Goodrow

[57] ABSTRACT

Photohardenable electrostatic master comprising an electrically conductive substrate, e.g., aluminized polyethylene terephthalate, bearing a layer of a photopolymer comprising an organic polymeric binder, compound having at least one ethylenically unsaturated group, photoinitiator, an aromatic amino compound, as defined, and an acid, e.g., p-toluene sulfonic acid, or an oxidized substituted aromatic amino compound. The photohardenable electrostatic master having improved charge decay and backtransfer is used for electrostatic proofing, etc.

47 Claims, No Drawings

PHOTOHARDENABLE ELECTROSTATIC MASTER HAVING IMPROVED BACKTRANSFER AND CHARGE DECAY

TECHNICAL FIELD

This invention relates to a photohardenable element for use as an electrostatic master. More particularly this invention relates to a photohardenable electrostatic master wherein a layer of a photohardenable composition comprising a polymeric binder, ethylenically unsaturated compound, photoinitiator and an aromatic amino compound of a basic dye, a leuco dye salt of the basic dye, and the combination of an azo dye salt and a strong acid is present on an electrically conductive substrate.

BACKGROUND OF THE INVENTION

Photopolymerizable compositions and films containing binder, monomer, initiator and chain transfer agent are described in the prior art and sold commercially. One important application of photopolymerizable layers is in graphic arts. A need exists in the graphic arts field to render faithful proofs which describe the image quality that can be attained prior to the printing process. Specifically, it is desirable to demonstrate the appearance and the quality of the printed product prior to its production. The actual mounting of printing plates on a printing press is expensive and time consuming. Adjustments in the printing plate are sometimes necessary in order to achieve the right tonal range, etc. In other cases, it is necessary to remake the plate, if there are any defects in it, such as may be caused by improper exposure of a separation negative from which a plate is generated.

A number of proofing processes are commercially available. Several of these are capable of giving separate films containing colored images, which on superimposition give a multicolored image that approximates the ultimate pattern generated on the printing press. Other processes depend on selectively toning layers of partially exposed surfaces, to give surprints which more closely resemble the images that are generated on printing than the overlay films described earlier. These processes, however, do not result in the most desired proof, i.e., one which gives a surprint that is indeed a printed image on unmodified paper stock as is used in printing. Furthermore, the previously cited methods do not permit the facile formation of multiple prints as are frequently required in the printing industry, as for example, when the proof is employed as a press guide in two different locations. The technology described in this case addresses the need to make multiple surprints and to overcome the limitations of several commercial proofing processes.

Photopolymerizable layers are currently being used as electrostatic masters for analog color proofing. For this application, a photopolymerizable or photohardenable layer is coated on an electrically conductive substrate and contact exposed with an ultraviolet (UV) source through a half-tone color separation negative. The photopolymer hardens in the areas exposed with an ultraviolet source due to polymerization and remains in a softer state elsewhere. The differences between the exposed and unexposed areas are apparent in the transport properties, i.e., the unexposed photopolymer conducts electrostatic charge while the UV exposed areas are substantially non-conductive. By subjecting the exposed photopolymer layer to a corona discharge a latent electrostatic image is obtained consisting of electrostatic charge remaining only in the nonconducting or exposed areas of the photopolymer layer. This latent image can then be developed by application of a liquid or dry electrostatic developer to the photopolymer surface. When the developer has the opposite charge as the corona charge, the developer selectively adheres to the exposed or polymerized areas of the photopolymer layer. It is desirable to permit selective toner deposition on the imagewise exposed charged photopolymer layer within a short time after charging. That is, there is the need for a more rapid decay of the unexposed (background) areas of the photopolymer or photohardenable layer. As long as a significant amount of charge resides on the unexposed (background) areas, developer will be deposited on these areas, therefore requiring a longer time period between charging and applying developer if background coloring is to be avoided. Although single color electrophotography is a reliable mature technique, color on color electrophotography is relatively new and the application of four different color developer layers on top of each other has its own problems.

While slow charge decay is a problem, we consider the most serious problem in the preparation of color proofs using electrostatic systems to be backtransfer. It was discovered that when a second color developer was transferred from the photohardenable master on top of an existing image on paper, the developer layer originally on the paper partially backtransferred to the electrostatic master during the second transfer. The backtransfer problem worsens when dealing with four layers of developer, since in that case all the previously transferred colors partially backtransfer from the paper onto the surface of the master. Therefore, the final image on paper is unacceptable due to its degraded color and resolution. In attempting to deal with the backtransfer problem we noted, for example, that the negatively charged toner particles in the liquid electrostatic developer when backtransferred surprisingly were found to have neutral or positive charges. This charge reversal or neutralization suggested that the large transfer fields partially electrolyzed the toner particles. Charge reversal also implied that toner particles will backtransfer since an electric field that drives negative particles towards the paper would drive positive particles towards the master.

Furthermore, we learned that the toner neutralization occurred on the paper and at the photopolymer electrodes. Backtransfer could be overcome by blocking the toner neutralization either by using dielectric coated paper or by washing the photopolymer layer surface with a solution of charge director and carrier liquid with conductivities above a determined threshold value. These approaches, however, were not practical as it is undesirable to use non-standard papers and washing the photopolymer layer surface.

Backtransfer has not been observed when the charged surface is a selenium photoconductor and is not as serious on silver halide masters. Charged photopolymer layers are different with respect to backtransfer. For example, up to 80% of a toned image can be backtransferred to a photopolymer master under high ambient humidities and high transfer field conditions. It is therefore believed that the resistivity of the transfer zone and the nature of the charge carrier play important roles in developer backtransfer. In order to attempt to overcome the problem of backtransfer, the photopolymer composition was formulated to include additives that modified the electrochemistry at the surface of the photopolymer layer so that the particular liquid electrostatic developer would transfer from the master onto the paper or subsequent transferred image layer without electrically modifying the toner particles of the developer.

It has now been found that the charge decay of unexposed areas of a photopolymer or photohardenable layer and the backtransfer of transferred liquid electrostatic developed images to the surface of the photohardenable layer can be greatly improved by introducing into a photohardenable composition a compound which is a basic dye, a leuco dye salt of the basic dye or an azo dye salt.

SUMMARY OF THE INVENTION

In accordance with this invention there is provided a high resolution, photohardenable electrostatic master comprising:

a. an electrically conductive substrate bearing b. a photohardenable layer consisting essentially of (1) an organic polymeric binder, (2) a compound having at least one ethylenically unsaturated group, (3) a photoinitiator and (4) an aromatic amino compound selected from the group consisting of a basic dye, a leuco dye salt of the basic dye, and the combination of an azo dye salt of the following formula and a strong acid (5) being present in the amount of 0.33 mole to 1.0 mole per mole of amino nitrogen of said compound (4)

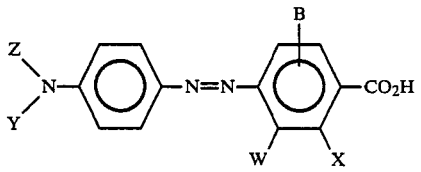

wherein Y and Z, which can be the same or different, are H, alkyl, halogen, hydroxy and alkoxy; W and X are individually H but when taken together can form a 6-membered aromatic ring; and B is H, alkyl, halogen and alkoxy.

DETAILED DESCRIPTION OF THE INVENTION

The photohardenable (photopolymerizable) layer of the electrostatic master consists essentially of an organic polymeric binder, a compound having at least one ethylenically unsaturated group which can be a monomer, a photoinitiator, a substituted aromatic amino compound as described more specifically below, and preferably a strong acid. Preferably a chain transfer agent is also present. Consisting essentially of means that there can be present in the photohardenable layer, in addition to the primary ingredients, other ingredients which do not prevent the advantages of the invention from being achieved. These other ingredients which can also be present are set out below. Polymeric binders, ethylenically unsaturated compounds, photoinitiators, including preferred hexaarylbiimidazole compounds (HABI's) and chain transfer agents are disclosed in Chambers U.S. Pat. No. 3,479,185, Baum et al. U.S. Pat. No. 3,652,275, Cescon U.S. Pat. No. 3,784,557, Dueber U.S. Pat. No. 4,162,162, and Dessauer U.S. Pat. No. 4,252,887, the disclosures of each of which are incorporated herein by reference.

Binders

Suitable binders include: the polymerized methylmethacrylate resins including copolymers thereof, polyvinyl acetals such as polyvinyl butyral and polyvinyl formal, vinylidene chloride copolymers (e.g., vinylidene chloride/acrylonitrile, vinylidene chloride/methacrylate and vinylidene chloride/vinylacetate copolymers), synthetic rubbers (e.g., butadiene/acrylonitrile copolymers and chloro-2-butadiene-1,3-polymers), cellulose esters (e.g., cellulose acetate, cellulose acetate succinate and cellulose acetate butyrate), polyvinyl esters (e.g., polyvinyl acetate/acrylate, polyvinyl acetate/methacrylate and polyvinyl acetate), polyvinyl chloride and copolymers (e.g., polyvinyl chloride/acetate), polyurethanes, polystyrene. Preferred binders are poly(styrene/methylmethacrylate) and polymethylmethacrylate. A preferred resistivity range of the exposed photohardened image areas is about $10^{14}$ to $10^{16}$ Ω-cm, corresponding to a resistivity for the binder of $10^{16}$ to $10^{20}$ Ω-cm range.

Ethylenically Unsaturated Compounds

Any ethylenically unsaturated photopolymerizable or photocrosslinkable compound identified in the prior patents for use in HABI-initiated systems can be used. The term "monomer" as used herein includes simple monomers as well as polymers, usually of molecular weight below 1500, having crosslinkable ethylenic groups. Preferred monomers are di-, tri- and tetra-acrylates and -methacrylates such as ethylene glycol diacrylate, diethylene glycol diacrylate, triethylene glycol diacrylate, glycerol diacrylate, glycerol triacrylate, ethylene glycol dimethacrylate, 1,2-propanediol dimethacrylate, 1,2,4-butanetriol trimethacrylate, 1,4-cyclohexanediol diacrylate, 1,4-benzenediol dimethacrylate, pentaerythritol tetramethacrylate, 1,3-propanediol diacrylate, 1,5-pentanediol dimethacrylate, pentaerythritol triacrylate; the bisacrylates and methacrylates of polyethylene glycols of molecular weight 100–500, etc. A particularly preferred monomer is ethoxylated trimethylolpropane triacrylate.

Impurities in the ethylenically unsaturated compound can be the major source of charge carriers. Therefore, the overall discharge rate of the photohardenable layer is determined largely by these ionizable impurities. In general, the resistivities of the ethylenically unsaturated compounds range from $10^5$ to $10^9$ Ω-cm with the resultant compositions having a resistivity of $10^{11}$ to $10^{13}$ Ω-cm in the unexposed areas of the photohardenable layer.

Initiators

Preferred initiators are the HABI photoinitiators, 2,2′4,4′,5,5′-hexaarylbiimidazoles, sometimes called 2,4,5-triarylimidazolyl dimers, which dissociate on exposure to actinic radiation to form the corresponding triarylimidazolyl free radicals. As indicated above, HABI's and use of HABI-initiated photopolymerizable systems for applications other than for electrostatic uses are disclosed in a number of patents. These include: Cescon U.S. Pat. No. 3,784,557; Chambers U.S. Pat. No. 3,479,185; Chang et al. U.S. Pat. No. 3,549,367; Baum et al. U.S. Pat. No. 3,652,275; Dueber U.S. Pat. No. 4,162,169; Dessauer U.S. Pat. No. 4,252,887; Chambers et al. U.S. Pat. No. 4,264,708; and Tanaka et al., U.S. Pat. No. 4,459,349; the disclosures of these patents are incorporated herein by reference. Any 2-o-substituted HABI disclosed in the prior patents can be used in this invention. The HABI's can be represented by the general formula

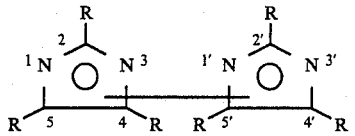

where the R's represent aryl radicals. The 2-o-substituted HABI's are those in which the aryl radicals at positions 2 and 2′ are ortho-substituted. The other positions on the aryl radicals can be unsubstituted or carry any substituent which does not interfere with the dissociation of the HABI upon exposure or adversely affect the electrical or other characteristics of the photopolymer system.

Preferred HABI's are 2-o-chlorosubstituted hexaphenylbiimidazoles in which the other positions on the phenyl radicals are unsubstituted or substituted with chloro, methyl or methoxy. The most preferred HABI's are 2,2′,4,4′-tetrakis(o-chlorophenyl)-5,5′-bis(m,p-dimethoxyphenyl)-biimidazole (TCTM-HABI) and 2,2′-bis-(o-chlorophenyl)-4,4′,5,5′-tetraphenylbiimidazole.

Processes for producing HABI compounds result in a mixture of isomers and other impurities. Use of high concentrations of these impure materials can provide photopolymerizable compositions with high sensitivity but poor shelflife or storage stability due to crystallization. It has been found that purification of the materials by various methods can provide relatively pure materials which can be used in high concentration without crystallization.

The HABI's can be purified sufficiently for use in this invention by merely dissolving them in methylene chloride, filtering and recrystallizing by adding methanol or ether. If desired, the solution of the HABI in methylene chloride can be eluted through a silica gel column prior to recrystallization. Preferred methods for purification of the preferred HABI's are as follows:

TCTM-HABI (1) Preferred method.

50 g of reddish brown TCTM-HABI (melting range 170°–215° C.) is added to 425 ml ethanol and 100 ml of distilled water. The slurry is stirred for 5 to 10 min. and allowed to settle for 30 min. Most of the supernatant red liquid is removed. 200 ml of distilled water is added and the fresh slurry is stirred 5 to 10 min. and filtered through #54 (fast) paper. The collected solid is dried at 120° C. for 3 to 5 hours. The yield of white solid is 44 g (88%) and with melting range (m.r.) 170° to 220° C.

(2) Alternate method 50 g of reddish brown TCTM-HABI is added to 250 ml ethanol and 200 ml of water. After stirring the slurry for 10 minutes, it is allowed to settle for 10 minutes prior to filtration through #5 (slow) paper. The solid is collected and after drying yields a white powder with similar yield and m.r. as above.

o-Cl-HABI 225 g of o-Cl-HABI (m.r. 205°–7° C.) is added to 1800 ml methylene chloride and solution heated to the boil. 150 g DARCO® G-60 charcoal activated, EM Science, a division of EM Industries, Inc., Cherry Hill, NJ is then added. The mixture is kept boiling for 30 to 45 min. prior to hot filtration through Celite® Diatomaceous Silica Product, Manville Products Corp., Denver, CO under vacuum. The filtrate is concentrated to yield ca. 135 g (60%) solid with m.r. 203°–5° C. The filter pad is washed with 200 ml of methylene chloride and the filtrate concentrated to yield ca. 45 g (20%) solid with m.r. 203°–207° C.

Additional photoinitiators that are also useful in the photohardenable composition include polynuclear quinones, aromatic ketones and benzoin ethers, useful polynuclear aquinones are: α-ethyl anthraquinone, 9,10-anthraquinone, 1-chloroanthraquinone, 2-chloroanthraquinone, 2-methylanthraquinone, 2-tert-butylanthraquinone, octamethylanthraquinone, 1,4-naphthoquinone, 9,10-phenanthrenequinone, 1,2-benzanthraquinone, 2,3-benzanthraquinone, 2-methyl-1,4-naphthoquinone, 2,3-dichloronaphthoquinone, 1,4-dimethylanthraquinone, 2,3-dimethylanthraquinone, 2-phenyl anthraquinone, 2,3-diphenylanthraquinone, sodium salt of anthraquinone α-sulfonic acid, 3-chloro-2-methylanthraquinone, retenequinone, 7,8,9,10-tetrahydronaphthacenequinone, 1,2,3,4-tetrahydrobenz-(a)anthracene-7,12-dione; aromatic ketones, e.g., benzophenone, Michler's ketone (4,4′-bis(dimethylamino)benzophenone), 4,4′-bis(diethylamino)benzophenone, 4-acryloxy-4′-dimethylaminobenzophenone, 4-acryloxy-4′-diethylaminobenzophenone, 4-methoxy-4′-dimethylaminobenzophenone, phenanthrenequinone, 2,7-di-t-butylphenanthrenequinone, etc.; benzoin ethers, e.g., benzoin methyl ether, benzoin ethyl ether and benzoin phenyl ether, methyl-benzoin benzoin, ethylbenzoin, etc.

Substituted Aromatic Amino Compounds

The presence in the photohardenable composition of at least 3% by weight (based on the total weight of the photohardenable composition or layer of an aromatic amino compound (4) having the general formulae:

A. basic dye:

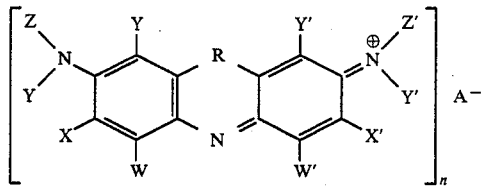

wherein

R is O, S, NH, NR′ where R′ is alkyl and substituted alkyl having 1 to 12 carbon atoms, preferably 1 to 6 carbon atoms, aryl and substituted aryl, having 6 to 10 carbon atoms, benzyl, and benzoyl;

V and V′, which can be the same or different, are H, halogen, e.g., Cl, Br, I, F; nitro, and alkoxy having 1 to 12 carbon atoms, preferably 1 to 6 carbon atoms, W, W′, X and X′ which can be the same or different, are H and alkyl, having 1 to 12 carbon atoms, preferably 1 to 6 carbon atoms, W+X and W′+X′ when taken together form a 6-membered aromatic ring, Y and Y′, which can be the same or different, are H, alkyl and substituted alkyl, having 1 to 12 carbon atoms, preferably 1 to 6 carbon atoms, Z and Z', which can be the same or different are H, alkyl and substituted alkyl having 1 to 12 carbon atoms, preferably 1 to 6 carbon atoms, aryl and substituted aryl having 6 to 10 carbon atoms, $A^-$ is a counterion, e.g., $Cl^-$, $Br^-$, $I^-$, $\phi SO_3^-$, $SO_4^=$, $HSO_4^-$, and $PO_4^{\equiv}$, and n is 1 to 3, or B. the oxidized state of the formula below which is the leuco dye salt:

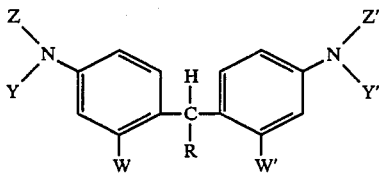

wherein

R is aryl and substituted aryl having 6–10 carbon atoms and a 5- or 6-membered conjugate heterocyclic group, Y and Y', which can be the same or different, are H, alkyl and substituted alkyl having 1–12 carbon atoms, preferably 1 to 6 carbon atoms, Z and Z', which can be the same or different, are H, alkyl and substituted alkyl having 1–12 carbon atoms, preferably 1–6 carbon atoms, aryl and substituted aryl 6–10 carbon atoms, and W and W', which can be the same or different, are H and alkyl having 1–12 carbon atoms, preferably 1–6 carbon atoms.

C. the combination of an azo dye (4) and a strong acid (5):

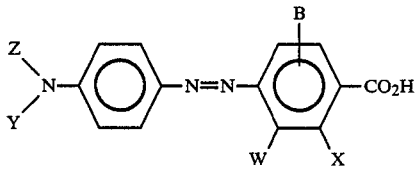

wherein Y and Z, which can be the same or different, are H, alkyl of having 1 to 12 carbon atoms, halogen, e.g., Cl, Br, I, F; hydroxy, and alkoxy having 1 to 11 carbon atoms; W and X are individually H but when taken together can form a 6-membered aromatic ring; and B is H, alkyl having 1 to 12 carbon atoms, halogen, e.g., Cl, Br, I, F; and alkoxy having 1 to 12 carbon atoms.

The class of stable leuco base triarylmethanes defined below comprises a large number of useful compounds. The compounds listed below are typical examples of compounds within the class defined used in combination with an acid or in their oxidized form.

Compound No.

(1) 4',4''-bis(diethylamino)-2',2''-dimethyltriphenylmethane
(2) 4',4''-diamino-4-dimethylamino-2',2'',5',5''-tetramethyltriphenylmethane
(3) 4',4''-bis(diethylamino)-2,6-dichloro-2',2''-dimethyltriphenylmethane
(4) 4',4''-bis(diethylamino)-2',2''-dimethyldiphenyl-α-naphthylmethane
(5) 2',2''-dimethyl-4,4',4''-tris(dimethylamino)-triphenylmethane
(6) 4',4''-bis(diethylamino)-4-dimethylamino-2',2'',5',5''-tetramethyltriphenylmethane
(7) 4',4''-bis(diethylamino)-2-chloro-2',2''-dimethyl-4-dimethylaminotriphenylmethane
(8) 4',4''-bis(diethylamino)-4-dimethylamino-2,2',2''-trimethyltriphenylmethane
(9) 4',4''-bis(dimethylamino)-2-chloro-2',2''-dimethyltriphenylmethane
(10) 4',4''-bis(dimethylamino)-2',2''-dimethyl-4-methoxytriphenylmethane
(11) 4',4''-bis(benzylethylamino)-2'2''-dimethyltriphenylmethane
(12) 4',4''-bis(diethylamino)-2',2'',5',5''-tetramethyltriphenylmethane
(13) 4',4''-bis(diethylamino)-2',2''-diethoxytriphenylmethane
(14) 4',4''-bis(diethylamino)-2',2''-dimethyldiphenyl-β-naphthylmethane
(15) 4',4''-bis(diethylamino)-2',2''-dimethyldiphenyl-9-anthrylmethane
(16) 4',4''-diamino-4-dimethylamino-2',2''-diethyl-5',5''-dichlorotriphenylmethane
(17) 4,4'4''-trisdiethylamino-2,2',2''-trimethyltriphenylmethane.

Other useful compounds include dye compounds and such compounds in leuco form, e.g., Leuco Crystal Violet, 4,4',4''-methylidenetris(N,N-dimethylaniline); Crystal Violet, Basic Violet 3; Methyl Green, Methylene Green, Leuco Malachite Green, 4,4'-benzylidenebis(N,N-dimethylaniline); Neutral Red, Methyl Red, Methylene Blue, Nile Blue A, bis-(p-diethylamino-o-tolyl)phenyl methane leuco dye salt, tris-(p-diethylamino-o-tolyl)methane, bis-(p-diethylamino-o-tolyl)-o-thenyl methane leuco dye salt. Tris-(p-diethylamino-o-tolyl)methane p-toluene sulfonate salt is preferred for compound (4).

In combination with a compound (4), in non-oxidized form, there is present in the photohardenable layer a strong acid (5) which is present in an amount of 0.33 mole to 1.0 mole per mole of amino nitrogen of compound (4), and the combination of compounds (4) and (5) being present in an amount of at least 3% by weight, with the proviso that compound (4) is present in an amount of at least 1.6% by weight, the weight percentages being based on the total weight of the photohardenable layer. Suitable strong acids are selected from the group consisting of amine salt-forming mineral acids, e.g., hydrochloric, hydrobromic, sulfuric, nitric, phosphoric, organic acids, e.g., p-toluenesulfonic, p-dodecylbenzene sulfonic, trichloroacetic, trifluoroacetic, perfluoroheptanoic, acetic, etc., and an acid from a compound supplying acid, e.g., Lewis acid selected from the group consisting of zinc chloride, zinc bromide, ferric chloride, etc. p-toluenesulfonic acid is a preferred strong acid.

The combination of compound (4) and acid (5) are present in a total amount of 3 to 15% by weight, preferably 3 to 5% by weight based on the total weight of the photohardenable layer. The ratio of compound (4) to acid (5) is one acid molecule per amino group molecule on a molar basis. We have found that not all acids in combination with compound (4) give sufficient back-transfer advantage. Acetic is an example of such an acid. This acid, in combination with compounds (4), however, does provide the charge decay advantage. The use of the oxidized form of compounds (4) alone also provides a charge decay advantage, e.g., Nile Blue A, Methylene Blue, Neutral Red, etc. We have found that generally the use of compound (4) alone does not provide a backtransfer advantage. Exceptions to this are Crystal Violet and Neutral Red in amounts of at least about 6% by weight.

Chain Transfer Agennt

Any chain transfer agent (CTA) identified in the prior patents for use with HABI-initiated photopolymerizable systems can be used. For example, Baum et al. U.S. Pat. No. 3,652,275 lists N-phenylglycine, 1,1-dimethyl-3,5-diketocyclohexane, and organic thiols such as 2-mercaptobenzothiazole, 2-mercaptobenzoxazole, 2-mercaptobenzimidazole, pentaerythritol tetrakis (mercaptoacetate), 4-acetamidothiophenol, mercaptosuccinic acid, dodecanethiol, and beta-mercaptoethanol. Others whih can be used include various tertiary amines known in the art, 2-mercaptoethane sulfonic acid, 1-phenyl-4H-tetrazole-5-thiol, 6-mercaptopurine monohydrate, bis-(5-mercapto-1,3,4-thiodiazol-2-yl, 2-mercapto-5-nitrobenzimidazole, and 2-mercapto-4-sulfo-6-chlorobenzoxazole. The preferred CTA's are 2-mercaptobenzoxazole (2-MBO) and 2-mercaptobenzothiazole (2-MBT). Especially preferred are 2-MBO and 2-MBT purified as illustrated below for 2-MBO:

2-MBO: Optimum Melting Point 193°-194° C.

(1) For slightly impure lots (m.r.: 191°-193° C.) the following procedure is employed:

A slurry of 300 g 2-MBO in 1500 ml methanol is stirred for 5 to 10 minutes and allowed to settle. Generally, the solvent layer assumes a red appearance due to impurities. The undissolved solid is filtered through #5 filter paper in a Buchner funnel with house vacuum. Solid is washed with cold methanol (1 100 ml portion), collected and dried in oven at 70°-80° C. for 3 to 5 hours, subsequently pulverized and dried for an additional hour. Yield is approximately 150 g (50%) of white powder, m.r. 193°-94° C.

(2) For impure lots (m.p. below 191° C.) the following procedure is used:

250 g brown 2-MBO, 50 g DARCO® G-60, charcoal activated, as described above, 1500 ml methylene chloride and 600 ml methanol are stirred in a 4 liter Erlenmeyer flask with gentle boiling for 30 to 40 minutes. The mixture is filtered hot through fast (#4) under low vacuum. The red liquor that is collected is concentrated under low vacuum until 2-MBO precipitates out of solution. 200 ml of fresh methanol is added, and the resulting slurry is agitated to break up large lumps. The slurry is filtered through slow (#5) paper and washed with 50 ml fresh methanol. The colorless precipitate is collected and dried at 70 to 80 degrees for 3 to 5 hours as above. Yield of product, melting above 192° C. is ca. 50%.

Additives

In addition to the primary ingredients and chain transfer agent, the photohardenable compositions can contain conventional ingredients such as co-initiators, thermal stabilizers, plasticizers, brighteners, energy transfer dyes (i.e., visible light sensitizers). UV absorbers, photoinhibitors, etc. The preferred thermal stabilizer is 1,4,4-trimethyl-2,3-diazobicyclo-(3.2.2)-non-2-ene-N,N-dioxide (TAOBN). Visible light sensitizers and photoinhibitors are disclosed in Dueber U.S. Pat. No. 4,162,162 and Pazos U.S. Pat. No. 4,198,242, respectively, the disclosure of which are incorporated herein by reference.

In general, the essential components should be used in the following approximate proportions: binder 40–75 percent, preferably 50–65 percent; monomer 15–40 percent; preferably 20–32 percent; initiator 1–20 percent, preferably 1–5 percent; and preferably a chain transfer agent 0–5 percent, preferably 0.1–4 percent. These are weight percentages based on total weight of the photopolymerizable composition. The preferred proportions depend upon the particular compounds selected for each component. For example, a high conductivity monomer can be used in smaller amount than a low conductivity monomer, since the former will be more efficient in eliminating charge from unexposed areas.

The amount of photoinitiator such as HABI and chain transfer agent, e.g., 2-MBO, etc. incorporated in the photohardenable layer will depend upon film speed requirement. Higher speed compositions can be used with laser imaging in recording digitized information, as in digital color proofing. For analog applications, e.g., exposure through a negative, film speed requirement depends upon mode of exposure. If the exposure device is a flat-bed type, where the negative is placed over the photopolymer matrix, exposures of up to 60 seconds can be used and a photographically slow film will be acceptable. For a drum exposure device, with a collimated source of radiation, the exposure per pixel may be brief and a higher speed photopolymer layer may be more useful.

The photohardenable layer is prepared by mixing the ingredients of the photopolymerizable system in a solvent such as methylene chloride, usually in a weight ratio of about 15:85 to 25:75, coating a substrate, and evaporating the coating. Coating thickness should be uniform and about 3 to 15 $\mu$m, preferably 7 to 12 $\mu$m dry. Dry coating weight should be about 30 to 150 mg/dm$^2$, preferably 70 to 120 mg/dm$^2$.

The conductive support may be a metal plate, such as aluminum, copper, zinc, silver or the like; a conductive polymeric film; a support such as paper, glass, synthetic resin and the like, which has been coated on one or both sides with a metal, conductive metal oxide, or metal halide by vapor deposition or sputtering chemical deposition; a support which has been coated with a conductive polymer; or a support which has been coated with a polymeric binder containing a metal, conductive metal oxide, metal halide, conductive polymer, carbon, or other conductive fillers.

Exposure/Charging/Toning/Transfer

Exposing radiation can be modulated by either digital or analog means. Analog exposure utilizes a line or half-tone negative or other pattern interposed between radiation source and film. For analog exposure, a UV light source is preferred, since the photopolymerizable system is most sensitive to shorter wavelength light. Digital exposure is by means of a computer controlled visible light-emitting laser which scans the film in raster fashion. For digital exposure a high speed film, i.e., one containing a high-level of HABI, chain transfer agent and sensitized to higher wavelength light with a sensitizing dye, may be used. Exposure must be sufficient to cause substantial polymerization in exposed areas and provide the required differential in conductivity between exposed and unexposed areas. Electron beam exposure can be used, but is not required, and is not preferred because of the expensive equipment required.

The preferred charging means is corona discharge. Other charging methods, e.g., discharge of a capacitor, can also be used.

Any electrostatic liquid developer and any method of developer application can be used. Preferred liquid electrostatic developers are suspensions of pigmented resin toner particles in nonpolar liquids which are charged with ionic or zwitterionic compounds. The nonpolar liquids normally used are the Isopar® branched-chain aliphatic hydrocarbons (sold by Exxon Corporation) which have a Kauri-butanol value of less than 30 and optionally containing various adjuvants as described in Mitchell U.S. Pat. No. 4,631,244 and 4,663,264, Taggi U.S. Pat. No. 4,670,370 and assignee's following U.S. patent application Ser. Nos. 804,385, filed Dec. 4, 1985, 854,610 filed Apr. 22, 1986, 856,392 filed Apr. 28, 1986, 857,326 and 857,349 both filed Apr. 30, 1986, and 880,155 filed June 30, 1986. These are narrow high-purity cuts of isoparaffinic hydrocarbon fractions with the following boiling ranges: Isopar®-G, 157°-176° C.; isopar®-H 176°-191° C.; Isopar®-K 177°-197° C.; Isopar®-L 188°-206° C.; Isopar®-M 207°-254° C.; Isopar®-V 254°-329° C. Preferred resins having an average particle size of less than 10 μm are copolymers of ethylene (80 to 99.9%)/acrylic or methacrylic acid (20 to 0%)/alkyl of acrylic or methacrylic acid where alkyl is 1 to 5 carbon atoms (0 to 20%), e.g., copolymers of ethylene (89%) and methacrylic acid (11%) having a melt index at 190° C. of 100. Preferred nonpolar liquid soluble ionic or zwitterionic components are lecithin and Basic Barium Petronate® oil-soluble petroleum sulfonate manufactured by Sonneborn Division of Witco Chemical Corp., New York, NY. Many of the monomers useful in the photohardenable composition are soluble in these Isopar® hydrocarbons, especially in Isopar®-L. Consequently, repeated toning with Isopar® based toners to make multiple copies can deteriorate the electrical properties of the master by extraction of monomer from unexposed areas. The preferred monomers are relatively insoluble in Isopar® hydrocarbons, and extended contact with these liquids does not unduly deteriorate films made with these monomers. Photohardenable electrostatic masters made with other, more soluble monomers can still be used to make multiple copies, using liquid toner having a dispersant with less solvent action.

After toning the toner image is transferred to another surface, such as paper for the preparation of a proof. Other substrates are polymeric film, or cloth. For making integrated circuit boards, the transfer surface can be an insulating board on which conductive circuit lines can be printed by this process, or it can be an insulating board covered with a conductor (e.g., a fiber glass board covered with a copper layer) on which a resist is printed by this process. Transfer is accomplished by electrostatic or other means, e.g. by contact with an adhesive receptor surface or applying pressure and heat. Electrostatic transfer can be accomplished in any known manner, e.g., by placing the paper in contact with the developed image using a tackdown roll or corona when held at negative voltages will press the two surfaces together assuring intimate contact. After tackdown a positive corona discharge is applied to the backside of the paper driving the toner particles of the developer off the photohardenable electrostatic master onto the paper. Preferably the transfer does not occur at a master-paper gap greater than the thickness of the developer layer, e.g., about 6 μm.

INDUSTRIAL APPLICABILITY

The photohardenable electrostatic master is particularly useful in the graphic arts field, especially in the area of color proofing wherein multicolor proofs are achieved. The improved photohardenable electrostatic master of this invention exhibits more rapid charge decay than previous photohardenable electrostatic masters that are not prepared from photohardenable compositions containing a substituted aromatic amino compound (4) and an acid (5), or an oxidized substituted aromatic amino compound. The preferred photohardenable electrostatic masters containing a substituted aromatic amino compound (4) and a strong acid (5) such as a sulfonic type acid, exhibit substantially no backtransfer when multi-colored proofs are prepared with liquid electrostatic developers. Other uses for the photohardenable master include preparation of printed circuit boards, resists, solder mask and photohardenable protective coatings, etc.

EXAMPLES

The following examples illustrate but do not limit the invention wherein the parts and percentages set out are by weight. In the examples below the results are expressed in terms of backtransfer latitude (backtransfer), voltage retained in unexposed areas (decay rate), or both, the determination of backtransfer and voltage retained in unhardened areas (decay rate) is determined as described below.

Except as indicated otherwise, the procedure in all examples was as follows:

A solution containing 86.5 parts of methylene chloride and 13.5 parts of solids consisting essentially of binder, monomer, initiator, chain transfer agent, sensitizer, dye, and generally an acid was hand coated onto 0.004 inch (0.0102 cm) aluminized polyethylene terephthalate support and a 0.075 inch (0.019 cm) polypropylene cover sheet was laminated to the air dried layer. The coating weights varied from 80 to 120 mg/dm$^2$ or about 7 μm to 12 μm in photopolymer layer thickness.

The photohardenable element was imagewise exposed for the time, in seconds, indicated in the examples through a UV light transmitting, visible light absorbing Kokomo® glass filter (No. 400), Kokomo Opalescent glass Co., Kokomo, IN, and a halftone negative film with its emulsion side in contact with the cover sheet on a Douthitt Option X Exposure Unit (Douthitt Corporation, Detroit, MI) equipped with a model TU 64 Vi-olux®5002 lamp assembly (Exposure Systems Corporation, Bridgeport, CT) and a photopolymer type 5027 lamp. The exposed element was mounted on a flat aluminum plate that was positioned on a friction free translational stage connected to a solenoid. The cover sheet was peeled off, and the element was then corona charged at a temperature of 23° C. and a relative humidity of approximately 45%. The element was moved from position A to B, 1 inch (2.54 cm) apart, by activating the solenoid. In position A, the element was placed directly under a scorotron for charging. After charging was completed, the element was moved to B away from the scorotron where the element was tested for Voltage Retained In Unpolymerized Areas (charge decay): The polymerized areas of the element were charged to 500 volts, and the voltage retained by the polymerized and unpolymerized areas of the master was measured 1.0 second after charging. The voltage retained in unpolymerized areas (decay rate) was measured using a Monroe Electrostatic Voltmeter, Model #174, Monroe Electronics, Lyndonville, NY, and by placing a Model 1017 sensing probe at about 1 mm from the surface of the photohardenable layer in an unhardened area.

To test for backtransfer, the above-described charged photohardenable element was toned with a cyan liquid electrostatic toner of the following composition

| CYAN INGREDIENTS | Amount (g) |
|---|---|
| Copolymer of ethylene (89%) and methacrylic acid (11%), melt index at 190° C. is 100, Acid No is 66 | 3,444.5 |
| Ciba-Geigy Monarch Blue X3627 | 616.75 |
| Dalamar ® Yellow YT858D | 6.225 |
| Aluminum tristearate, Witco 132 | 83.0 |
| Basic Barium Petronate ® | 311.25 |
| Isopar ® -L, non-polar liquid having a Kauri-butanol value of 27, Exxon Corporation | 16,600.0 |

and the image transferred to paper at 2.2 inches/second (5.588 cm/sec.). The charging corona voltage and current were adjusted to give SWOP (Specification Web Offset Publications) density in solid areas. Standard conditions were 100 to 250 V in the scorotron grid, 200 to 400 μA charging corona current and 5.11 to 5.84 kV charging corona voltage.

After the transfer of the first image was completed, the photohardenable element was tested for backtransfer latitude in three sequential charging, toning and transferring cycles as follows: the paper, with a wet image on top, was carefully placed in the transfer position. The leading edges of the photohardenable element and the wet image on paper were aligned 1 inch (2.54 cm) apart and the paper leading and trailing edges were held away from the photohardenable element. The electrostatic master was cleaned and the second charging, toning and transferring cycle started. A second toner layer on top of the original image was thus obtained. The transfer and backtransfer efficiencies were evaluated by an operator standing by the exit of the transfer zone. After the second transfer was completed the procedure was repeated a third and a fourth time always checking for backtransfer. These four passes simulate the actual making of a 4-color proof in which the image first toned is subjected to the transfer field three other times before the proof is completed. The above procedure was repeated for each of the following transfer conditions: 1) $I_t=100$ (4.63 kV), 200 (5.11 kV) and 400 μA (5.84 kV) for $V_{tk}=-2.5$ kV, and 2) $I_t=200$ μA (5.11 kV) and $V_{tk}=-4.0$ kV; where $I_t$ is the transfer corona current and $V_{tk}$ is the tackdown roll voltage. Although these parameters are extreme compared to standard transfer conditions of $I_t$, $<100$ μA, the amount of toner backtransfer clearly increases with transfer corona current and tackdown roll voltage. Consequently, a photohardenable layer that would not backtransfer under these conditions should be suitable as an electrostatic master in a multiple color system.

In the examples, ingredient and other abbreviations have the following meaning:

| | |
|---|---|
| | BINDERS |
| PMMA | polymethylmethacrylate<br>$\eta$ = 1.25, where $\eta$ is the inherent viscosity<br>$T_g$ = 95° C. where $T_g$ is the glass transition temperature |

-continued

| | |
|---|---|
| PSMMA | poly(styrene/methylmethacrylate)70/30 |
| | MONOMERS |
| TMPEOTA | ethoxylated trimethylol propane triacrylate |
| PRO280 | ethoxylated trimethylol propane triacrylate (degree of ethoxylation = 9) |
| TMPTA | trimethylol propane triacrylate |
| SR210 | tetraethylene glycol propane triacrylate |
| | INITIATORS |
| TCTM-HABI | 2,2',4,4'-tetrakis(o-chlorophenyl)-5,5'-bis(m,p-dimethoxyphenyl)-biimidazole (recrystallized from methanol/methylene chloride) |
| BME | benzoin methyl ether |
| | CHAIN TRANSFER AGENTS |
| 2-MBO | 2-mercaptobenzoxazole |
| 2-MBI | 2-mercaptobenzimidazole |
| | STABILIZER |
| TAOBN | 1,4,4-trimethyl-2,3-diazobicyclo-{3,2,2}-non-2-ene-N,N—dioxide |
| | SURFACE CHEMISTRY MODIFIERS |
| A.Dyes | |
| LCV | Leuco Crystal Violet |
| CV | Crystal Violet, CI 42555 |
| mG | Methyl Green |
| MG | Methylene Green, CI 52020 |
| LMG | Leuco Malachite Green |
| LG1 | bis-(p-diethylamino-o-tolyl)phenylmethane leuco dye |
| TLA-454 | tris-(p-diethylamino-o-tolyl)methane |
| LB-3 | bis-(p-diethylamino-o-tolyl)-o-thenyl methane leuco dye |
| NR | Neutral Red. CI 50040 |
| MR | Methyl Red |
| MB | Methylene Blue, CI 52015 |
| NB | Nile Blue A, CI 51180 |
| B. Acids | |
| TSA | p-toluene sulfonic acid |
| DBSA | p-dodecyl benzene sulfonic acid |

Other Abbreviations
1st is the second image transferred
2nd is the third image transferred
3rd is the fourth image transferred
P is poor transfer efficiency
N is substantially no backtransfer
L is low backtransfer
Y is fair backtransfer In Control 1 and Examples 1 to 4 the coating weight of the dry photohardenable layer was 120 mg/dm$^2$±5 mg/dm$^2$. The imagewise exposure was for 4 seconds. The voltage retained in unpolymerized areas of these photohardenable elements is found in Table 1 below.

CONTROL 1

| INGREDIENTS | AMOUNT (g) |
|---|---|
| TMPEOTA | 28.60 |
| PSMMA | 57.00 |
| TCTM-HABI | 10.60 |
| 2-MBO | 3.80 |
| TAOBN | 0.03 |

EXAMPLE 1

| INGREDIENTS | AMOUNT (g) |
|---|---|
| TMPEOTA | 28.60 |
| PSMMA | 52.60 |
| TCTM-HABI | 10.60 |
| 2-MBO | 3.80 |
| TLA-454 | 2.20 |
| TSA | 2.20 |
| TAOBN | 0.03 |

EXAMPLE 2

| INGREDIENTS | AMOUNT (g) |
|---|---|
| TMPEOTA | 28.60 |
| PSMMA | 53.00 |
| TCTM-HABI | 10.60 |
| 2-MBO | 3.80 |
| LGI | 1.90 |
| TSA | 2.10 |
| TAOBN | 0.03 |

EXAMPLE 3

| INGREDIENTS | AMOUNT (g) |
|---|---|
| TMPEOTA | 28.60 |
| PSMMA | 53.00 |
| TCTM-HABI | 10.60 |
| 2-MBO | 3.80 |
| LB3 | 1.90 |
| TSA | 2.10 |
| TAOBN | 0.03 |

EXAMPLE 2

| INGREDIENTS | AMOUNT (g) |
|---|---|
| TMPEOTA | 28.60 |
| PSMMA | 52.60 |
| TCTM-HABI | 10.60 |
| 2-MBO | 3.80 |
| TLA-454 | 2.20 |
| TAOBN | 0.03 |

The results of Controls 1 and 2 and Examples 1 to 3 are shown in Table 1 below.

TABLE 1

| EX. OR CONT. | VOLTAGE RETAINED IN UNEXPOSED AREAS 1 SEC AFTER CHARGING |
|---|---|
| CONTROL 1 | 76 |
| EX. 1 | 15 |
| EX. 2 | 06 |
| EX. 3 | 18 |
| CONTROL 2 | 25 |

EXAMPLE 4

| SAMPLE* | PARTS TMPEOTA | TCTM HABI | 2-MBO | TLA-454 | TSA | PMMA |
|---|---|---|---|---|---|---|
| 1 | 24 | 5 | 4 | 5.0 | 5.0 | 57 |
| 2 | 26 | 5 | 4 | 4.0 | 4.0 | 58 |
| 3 | 27 | 5 | 4 | 3.5 | 3.5 | 57 |
| 4 | 27 | 5 | 3 | 3.0 | 3.0 | 58 |
| 5 | 27 | 5 | 4 | 3.0 | 3.0 | 58 |
| 6 | 28 | 5 | 4 | 2.5 | 2.5 | 58 |
| 7 | 29 | 5 | 4 | 2.0 | 2.0 | 58 |
| 8 | 30 | 5 | 4 | 1.5 | 1.5 | 58 |
| 9 | 32 | 5 | 4 | 1.0 | 1.0 | 57 |

*3 seconds exposure

Backtransfer results are shown in Table 2 below.

TABLE 2

| SAMPLE | BACKTRANSFER 100 μA, −2.5 kV 1st | 2nd | 3rd | 200 μA, −2.5 kV 1st | 2nd | 3rd | 400 μA, −2.5 kV 1st | 2nd | 3rd | 200 μA, −4.0 kV 1st | 2nd | 3rd |
|---|---|---|---|---|---|---|---|---|---|---|---|---|
| 1 | N | N | N | N | N | N | N | N | N | N | N | N |
| 2 | N | N | N | N | N | N | N | N | N | N | N | N |
| 3 | N | N | N | N | N | N | N | N | N | N | N | N |
| 4 | N | N | N | N | N | N | N | N | N | N | N | N |
| 5 | N | N | N | N | N | N | N | N | N | N | N | N |
| 6 | N | N | N | N | N | L | N | N | L | N | N | N |
| 7 | N | N | N | N | L | P | N | L | P | Y | Y | Y |
| 8 | N | N | L | N | P | P | N | P | Y | Y | Y | Y |
| 9 | N | N | L | L | L | Y | L | Y | Y | L | Y | Y |

EXAMPLE 5

| SAMPLE | PARTS TMPEOTA | TCTM-HABI | BME | 2-MBO | 2-MBI | CV | TSA | mG | PMMA | τ | V° |
|---|---|---|---|---|---|---|---|---|---|---|---|
| 1 | 20 | 2 | | 3 | | 15.5 | | | 59.5 | | |
| 2 | 25 | 2 | | 3 | | 10 | | | 60 | | |
| 3 | 26 | 2 | | 3 | | 7.5 | | | 61.5 | | |
| 4 | 28 | 2 | | 3 | | 5 | | | 62 | | |
| 5 | 30 | 2 | | 3 | | 2.5 | | | 62.5 | | |
| 6 | 25 | 2 | | 3 | | 2.5 | 0.5 | | 67 | | |
| 7 | 26 | | 5 | | 4 | 8 | | | 57 | | |
| 8 | 25 | 2 | | 3 | | | | 10 | 60 | 1 | 30 |
| 9* | 27.77 | 2.22 | | 3.33 | | | | | 66.6 | 2 | 15 |
| 10 | 25.5 | 2 | | 3 | | | 2.5 | 6 | 61 | | |

*Sample 9 is a control

Exposure times: Samples 1 to 3, 7 are 120 sec.; Samples 4 to 6, 8 to 10 are 60 sec.

τ is the transit time in seconds of the unexposed areas

V° is the voltage retained by the unexposed areas at 0.1 second

Results are shown in Table 3 below.

TABLE 3

| SAMPLE | BACKTRANSFER 100 μA, −2.5 kV | | | 200 μA, −2.5 kV | | | 400 μA, −2.5 kV | | | 200 μA, −4.0 kV | | |
|---|---|---|---|---|---|---|---|---|---|---|---|---|
| | lst | 2nd | 3rd | lst | 2nd | 3rd | lst | 2nd | 3rd | lst | 2nd | 3rd |
| 1 | N | N | N | N | N | N | N | N | N | N | N | N |
| 2 | N | N | N | N | N | N | N | N | N | N | N | N |
| 3 | N | N | N | N | N | N | N | N | N | N | N | N |
| 4 | N | N | N | N | L | L | N | L | Y | N | L | Y |
| 5 | N | L | L | L | L | Y | L | Y | Y | L | Y | Y |
| 6 | N | N | N | N | N | N | N | N | N | N | N | N |
| 7 | N | N | N | N | N | N | N | N | N | N | N | N |
| 8 | N | N | L | N | L | L | P | P | P | P | P | P |
| 10 | N | N | N | N | N | N | N | N | N | N | N | N |

EXAMPLE 6

| SAMPLE | PARTS TMPEOTA | TCTM-HABI | 2-MBO | LCV | LG1 | LG | TSA | PMMA |
|---|---|---|---|---|---|---|---|---|
| 1 | 26.5 | 3 | 2 | 5.0 | | | 1.5 | 62 |
| 2 | 27 | 3 | 2 | 2.5 | | | 1.0 | 65 |
| 3 | 27 | 2 | 3 | 3.0 | | | 3.0 | 62 |
| 4 | 27 | 3 | 3 | 4.0 | | | 3.0 | 60 |
| 5 | 27 | 1 | 3 | | 10 | | 3.0 | 56 |
| 6 | 26 | 2 | 3 | | 7 | | 3.5 | 58.5 |
| 7 | 26 | 2 | 3 | | | 7 | 3.5 | 58.5 |
| 8 | 27 | 1 | 3 | | | 9 | 2.0 | 58 |

Exposure times are 16 seconds

Results are shown in Table 4 below.

TABLE 4

| SAMPLE | BACKTRANSFER 100 μA, −2.5 kV | | | 200 μA, −2.5 kV | | | 400 μA, −2.5 kV | | | 200 μA, −4.0 kV | | |
|---|---|---|---|---|---|---|---|---|---|---|---|---|
| | lst | 2nd | 3rd | lst | 2nd | 3rd | lst | 2nd | 3rd | lst | 2nd | 3rd |
| 1 | N | N | N | N | N | N | N | N | N | N | N | N |
| 2 | N | N | N | N | N | N | N | N | N | N | N | N |
| 3 | N | N | N | N | N | N | N | N | N | N | N | N |
| 4 | N | N | N | N | N | N | N | N | N | N | N | N |
| 5 | N | N | N | N | N | N | N | N | N | N | N | N |
| 6 | N | N | N | N | N | N | N | N | N | N | N | N |
| 7 | N | N | N | N | N | N | N | N | N | N | N | N |
| 8 | N | N | N | N | N | N | N | N | N | N | N | N |

EXAMPLE 7

| SAMPLE | PARTS TMPEOTA | TCTM HABI | 2-MBO | MR | TSA | PMMA | τ | V° |
|---|---|---|---|---|---|---|---|---|
| 1 | 26.5 | 2 | 3 | 5 | 1.5 | 62 | | |
| 2 | 26.5 | 2 | 3 | 2.5 | 1 | 65 | | |
| 3 | 26.5 | 2 | 3 | 5 | | 63.5 | 1.5 | 25 |
| 4* | 27.89 | 2.1 | 3.15 | | | 66.84 | 2.0 | 40 |

*Sample 4 is a control
Exposure times are 180 sec.
τ (see Ex. 5)
V° (see Ex. 5)

Results are shown in Table 5 below.

TABLE 5

| SAMPLE | BACKTRANSFER 100 μA, −2.5 kV | | | 200 μA, −2.5 kV | | | 400 μA, −2.5 kV | | | 200 μA, −4.0 kV | | |
|---|---|---|---|---|---|---|---|---|---|---|---|---|
| | lst | 2nd | 3rd | lst | 2nd | 3rd | lst | 2nd | 3rd | lst | 2nd | 3rd |
| 1 | N | N | N | N | N | N | N | N | N | N | N | N |
| 2 | N | N | N | N | N | N | N | N | N | N | N | N |
| 3 | N | L | L | L | L | L | P | P | P | L | L | L |

EXAMPLE 8

| SAMPLE | TMPEOTA | TCTM-HABI | 2-MBO | NR | NB | MB | TSA | PMMA |
|---|---|---|---|---|---|---|---|---|
| | PARTS | | | | | | | |
| 1 | 26 | 2 | 3 | | 12.5 | | | 56.5 |
| 2 | 26.4 | 2.8 | 3.7 | | 2.5 | | 2.5 | 62 |
| 3 | 30 | 2 | 3 | | | 6 | | 56 |
| 4 | 26 | 2.5 | 3 | | | 2.5 | 1.0 | 65 |
| 5 | 29.5 | 2 | 3 | 5.5 | | | | 60 |
| 6 | 25 | 2 | 3 | 10 | | | | 60 |
| 7 | 26.5 | 2 | 3 | 5 | | | 1.5 | 62 |
| 8 | 26.5 | 2 | 3 | 2.5 | | | 1.0 | 65 |

Exposure times: Samples 1 to 4 are 300 sec.; Samples 5 to 8 are 240 sec.

Results are shown in Table 6 below.

TABLE 6

| SAMPLE | 100 μA, −2.5 kV | | | 200 μA, −2.5 kV | | | 400 μA, −2.5 kV | | | 200 μA, −4.0 kV | | |
|---|---|---|---|---|---|---|---|---|---|---|---|---|
| | BACKTRANSFER | | | | | | | | | | | |
| | lst | 2nd | 3rd | lst | 2nd | 3rd | lst | 2nd | 3rd | lst | 2nd | 3rd |
| 1 | N | N | N | N | L | L | L | L | L | N | L | L |
| 2 | N | N | N | N | N | N | N | N | N | N | N | N |
| 3 | N | N | L | N | L | L | L | L | Y | L | L | Y |
| 4 | N | N | N | N | N | N | N | N | N | N | N | N |
| 5 | N | N | N | N | L | L | L | L | L | N | L | L |
| 6 | N | N | N | N | N | L | N | L | L | N | N | L |
| 7 | N | N | N | N | N | N | N | L | N | N | N | N |
| 8 | N | N | N | N | N | N | N | N | N | N | N | N |

EXAMPLE 9

| SAMPLE | TMPTA | PRO208 | SR210 | TCTM-HABI | 2-MBO | TLA | TSA | DBSA | PMMA | PSMMA |
|---|---|---|---|---|---|---|---|---|---|---|
| | PARTS | | | | | | | | | |
| 1 | 30 | | | 5 | 3 | 3 | 3 | | | 56 |
| 2 | | 27 | | 5 | 3 | 3 | 3 | | 59 | |
| 3 | | | 27 | 5 | 3 | 3 | 3 | | | 59 |
| 4 | | 22 | | 5 | 3 | | 3 | 10 | 57 | |

Results are shown in Table 7 below.

TABLE 7

| SAMPLE | 100 μA, −2.5 kV | | | 200 μA, −2.5 kV | | | 400 μA, −2.5 kV | | | 200 μA, −4.0 kV | | |
|---|---|---|---|---|---|---|---|---|---|---|---|---|
| | BACKTRANSFER | | | | | | | | | | | |
| | lst | 2nd | 3rd | lst | 2nd | 3rd | lst | 2nd | 3rd | lst | 2nd | 3rd |
| 1 | N | N | L | P | L | L | P | P | L | P | L | L |
| 2 | N | N | N | N | N | N | N | N | N | N | N | N |
| 3 | N | N | N | N | N | L | N | L | L | N | N | N |
| 4 | N | N | N | N | N | N | N | N | N | N | N | N |

EXAMPLE 10

A photopolymerizable composition was prepared containing the following ingredients.

| INGREDIENTS | AMOUNT (g) |
|---|---|
| PSMMA | 41,288 |
| TMPEOTA | 22,500 |
| TCTM-HABI | 8,380 |
| 2-MBO | 3,038 |
| TLA-454 | 1,744 |
| TSA | 1,744 |
| Methylene Chloride | 146,188 |
| TAOBN | 21 |

The solution was stirred for 24 hours to properly dissolve all components. It was coated on aluminized polyethylene terephthalate at 150 feet/minute (45.7 m/minute). The coating weight was approximately 100 mg/dm$^2$. A polypropylene cover sheet was placed on the photopolymer surface immediately after drying.

The photopolymer master formed was cut into 20 inches by 30 inches sheets (50.8 by 76.2 cm) and tested for its 4-color proofing characteristics.

A four color proof is obtained by following the steps described below. First, complementary registration marks are cut into the photopolymerizable layers of the masters prior to exposure. Four color separation negatives are prepared by exposing four photopolymerizable elements to the four color separation negatives corresponding to cyan, yellow, magenta and black colors. Each of the four photopolymerizable masters is exposed for 3 seconds using a Douthitt X exposure unit described above. The visible radiation emitted by this source is suppressed by a Kokomo® glass filter also as described above and the total emitted intensity is reduced by 75% with the use of a 25% transmission screen. The cover sheets are removed and each master is mounted on the corresponding color module drum, in a position assuring image registration of the four images as they are sequentially transferred from each master to the receiving paper. The leading edge clamps are also used to ground the photopolymer aluminized backplane to the drum. The masters are stretched by spring loading the trailing edge assuring that each laid flat against its drum.

Each module comprised a charging scorotron at 3 o'clock position, a developing station at 6 o'clock, a metering station at 7 o'clock and a cleaning station at 9 o'clock. The charging, toning and metering procedure is similar to that described above prior to the examples. The transfer station consists of a tackdown roll, a transfer corona, paper loading, and a positioning device that fixes the relative position of paper and master in all four transfer operations.

In the preparation of the four-color proof the four developers have the following compositions:

| INGREDIENTS | AMOUNT (g) |
|---|---|
| BLACK | |
| Copolymer of ethylene (89%) and methacrylic acid (11%), melt index at 190° C. is 100, Acid No. is 66 | 2,193.04 |
| Sterling NF carbon black | 527.44 |
| Heucophthal Blue, G XBT-583D Heubach, Inc., Newark, NJ | 27.76 |
| Basic Barium Petronate ® | 97.16 |
| Aluminum tristearate, Witco 132 | 27.76 |
| Isopar ® -L, non-polar liquid having a Kauri-Butanol value of 27, Exxon Corporation | 13,047.0 |
| CYAN | |
| Copolymer of ethylene (89%) and methacrylic acid (11%), melt index at 190° C. is 100, Acid No. is 66 | 3,444.5 |
| Ciba-Geigy Monarch Blue X3627 | 616.75 |
| Dalamar ® Yellow YT-858D Heubach, Inc., Newark, NJ | 6.225 |
| Aluminum tristearate, Witco 132 | 83.0 |
| Basic Barium Petronate ® | 311.25 |
| Isopar ® -L, non-polar liquid having a Kauri-butanol value of 27, Exxon Corporation | 16,600.0 |
| MAGENTA | |
| Copolymer of ethylene (89%) and methacrylic acid (11%), melt index at 190° C. is 100, Acid No. is 66 | 4,380.51 |
| Mobay RV-6700, Mobay Chemical Corp, Haledon, NJ | 750.08 |
| Mobay RV-6713, Mobay Chemical Corp., Haledon, NJ | 750.08 |
| Aluminum tristearate, Witco 132 | 120.014 |
| Triisopropanol amine | 75.008 |
| Basic Barium Petronate ® | 720.08 |
| Isopar ® -L, non-polar liquid having a Kauri-butanol value of 27, Exxon Corporation | 32,540.0 |
| YELLOW | |
| Copolymer of ethylene (89%) and methacrylic acid (11%), melt index at 190° C. is 100, Acid No. is 66 | 1,824.75 |
| Yellow 14 polyethylene flush Sun Chemical Co. | 508.32 |
| Aluminum tristearate, Witco 132 | 46.88 |
| Basic Barium Petronate ® | 59.5 |
| Isopar ® -L, non-polar liquid having a Kauri-butanol value of 27, Exxon Corporation | 11,570.0 |

First, the yellow master is charged, developed and metered. The transfer station is positioned and the toned yellow image transferred onto the paper. After the yellow transfer is completed, the magenta master is corona charged, developed and metered, and the magenta image transferred, in registry, on top of the yellow image. Afterwards, the cyan master is corona charged, developed, and metered, and the cyan image is transferred on top of the two previous images. Finally the black master is corona charged, developed, metered, and the toned black image transferred, in registry, on top of the three previously transferred images. After the procedure is completed, the paper is carefully removed from the transfer station and the image fused for 15 seconds at 100° C.

The parameters used for preparation of the proof are: drum speed, 2.2 inches/sec. (5.588 cm/sec.); grid scorotron voltage, 100 to 200 V; scorotron current 200 to 400 μA (5.11 to 5.84 kV); metering roll voltage, 20 to 50 V; tackdown roll voltage, −2.5 to −5.0 kV; transfer corona current, 50 to 150 μA (4.35 to 4.88 kV); metering roll speed, 4 to 8 inches/sec (10.16 to 20.32 cm/sec.); metering roll gap, 0.002 to 0.005 inch (~0.051 to 0.0127 mm); developer conductivity 12 to 30 picomhos/cm; developer concentration, 1 to 1.5% solids.

We claim:

1. A high resolution, photohardenable electrostatic master comprising:

a. an electrically conductive substrate bearing b. a photohardenable layer consisting essentially of (1) an organic polymeric binder, (2) a compound having at least one ethylenically unsaturated group, (3) a photoinitiator and (4) an aromatic amino compound selected from the group consisting of (i) a basic dye, (ii) a leuco dye salt of the basic dye and (iii) the combination of a strong acid (5) present in the amount of 0.33 mole to 1.0 mole per mole of amino nitrogen of said compound (4) and an azo dye salt of the formula

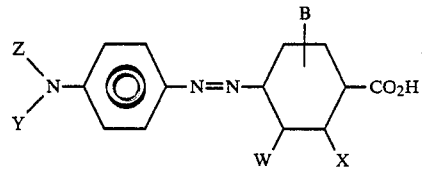

wherein

Y and Z, which can be the same or different, are H, alkyl, halogen, hydroxy and alkoxy; W and X are individually H but when taken together can from a 6-membered aromatic ring; and B is H, alkyl, halogen and alkoxy.

2. A photohardenable electrostatic master according to claim 1 wherein the basic dye or leuco dye salt of the basic dye are of the formulae:

A.

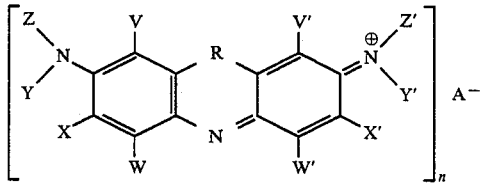

wherein

R is O, S, NH, NR' where R' is alkyl, substituted alkyl, aryl, substituted aryl, benzyl, and benzoyl;

V and V', which can be the same or different, are H, halogen, nitro, and alkoxy, W, W', X and X' which can be the same or different, are H and alkyl, W+X and W'+X' when taken together form a 6-membered aromatic ring, Y and Y', which can be the same or different, are H, alkyl and substituted alkyl, Z and Z', which can be the same or different are H, alkyl, substituted alkyl, aryl and substituted aryl, A is a counterion, and n is 1 to 3, or B. the oxidized state of the leuco dye salt of the formula:

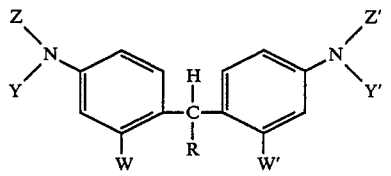

wherein

R is aryl, substituted aryl and a 5- or 6-membered conjugated heterocyclic group, Y and Y', which can be the same or different, are H, alkyl and substituted alkyl, Z and Z', which can be the same or different, are H, alkyl, substituted alkyl, aryl and substituted aryl, and W and W', which can be the same or different, are H and alkyl.

3. A photohardenable electrostatic master according to claim 1 wherein compound (4) is Crystal Violet.

4. A photohardenable electrostatic master according to claim 1 wherein compound (4) is Methyl Red.

5. A photohardenable electrostatic master according to claim 1 wherein compound (4) is Neutral Red.

6. A photohardenable electrostatic master according to claim 1 wherein compound (4) is Methylene Blue.

7. A photohardenable electrostatic master according to claim 1 wherein compound (4) is Methyl Green.

8. A photohardenable electrostatic master according to claim 1 wherein compound (4) is Nile Blue A.

9. A photohardenable electrostatic master according to claim 1 wherein a chain transfer agent is present.

10. A photohardenable electrostatic master according to claim 9 wherein the chain transfer agent is 2-mercaptobenzoxazole.

11. A photohardenable electrostatic master according to claim 9 wherein binder (1) is polymethylmethacrylate, ethylenically unsaturated compound (2) is ethoxylated trimethylol propane triacrylate, photoinitiator (3) is 2,2',4,4'-tetrakis (o-chlorophenyl)-5,5'-bis(m, p-dimethoxyphenyl)biimidazole, compound (4) is Crystal Violet and the chain transfer agent is 2-mercaptobenzoxazole.

12. A photohardenable electrostatic master according to claim 11 wherein photoinitiator (3) is benzoin methyl ether and the chain transfer agent is 2-mercaptobenzimidazole.

13. A photohardenable electrostatic master according to claim 1 wherein compound (4) is selected from the group consisting of Leuco Crystal Violet, Crystal Violet, Methyl Green, Methylene Green, Leuco Malachite Green, Neutral Red, Methyl Red, Methylene Blue, Nile Blue A, bis-(p-diethylamino-o-tolyl)phenyl methane leuco dye salt, tris-(p-diethylamino-o-tolyl)methane salt and bis-(p-diethylamino-o-tolyl)O-thenyl methane leuco dye salt.

14. A photohardenable electrostatic master according to claim 13 wherein compound (4) is tris-(p-diethylamino-o-tolyl)methane salt.

15. A photohardenable electrostatic master according to claim 13 wherein compound (4) is bis-(p-diethylamino-o-tolyl)phenyl methane leuco dye salt.

16. A photohardenable electrostatic master according to claim 13 wherein compound (4) is bis-(p-diethylamino-o-tolyl)o-thenyl methane leuco dye salt.

17. A photohardenable electrostatic master according to claim 13 wherein compound (4) is Crystal Violet.

18. A photohardenable electrostatic master according to claim 13 wherein compound (4) is Methyl Green.

19. A photohardenable electrostatic master according to claim 13 wherein compound (4) is Leuco Crystal Violet.

20. A photohardenable electrostatic master according to claim 13 wherein compound (4) is Leuco Malachite Green.

21. A photohardenable electrostatic master according to claim 13 wherein compound (4) is Methyl Red.

22. A photohardenable electrostatic master according to claim 13 wherein compound (4) is Neutral Red.

23. A photohardenable electrostatic master according to claim 13 wherein compound (4) is Nile Blue A.

24. A photohardenable electrostatic master according to claim 13 wherein compound (4) is Methylene Blue.

25. A photohardenable electrostatic master according to claim 13 wherein the strong acid is selected from the group consisting of amine salt-forming mineral acid, organic acid and an acid from a compound supplying acid.

26. A photohardenable electrostatic master according to claim 25 wherein the acid is an amine salt-forming mineral acid selected from the group consisting of hydrochloric, hydrobromic, sulfuric, nitric and phosphoric acid.

27. A photohardenable electrostatic master according to claim 25 wherein the acid is an organic acid selected from the group consisting of p-toluenesulfonic, p-dodecylbenzenesulfonic, trichloroacetic, trifluoroacetic, perfluoroheptanoic, and acetic acid.

28. A photohardenable electrostatic master according to claim 25 wherein the acid is a Lewis acid selected from the group consisting of zinc chloride, zinc bromide, and ferric chloride.

29. A photohardenable electrostatic master according to claim 1 wherein the acid is p-toluenesulfonic acid.

30. A photohardenable electrostatic master according to claim 2 wherein the photoinitiator is a hexaarylbiimidazole compound.

31. A photohardenable electrostatic master according to claim 2 wherein the hexaarylbiimidazole compound is 2,2',4,4'-tetrakis(o-chlorophenyl)-5,5'-bis(m,p-dimethoxyphenyl)-biimidazole.

32. A photohardenable electrostatic master according to claim 9 wherein the chain transfer agent is 2-mercaptobenzimidazole.

33. A photohardenable electrostatic master according to claim 1 wherein the binder is polymethylmethacrylate.

34. A photohardenable electrostatic master according to claim 1 wherein the binder is poly(styrene/methylmethacrylate).

35. A photohardenable electrostatic master according to claim 1 wherein compound (2) having at least one ethylenically unsaturated group is ethoxylated trimethylol propane triacrylate.

36. A photohardenable electrostatic master according to claim 1 wherein the electrically conductive substrate is aluminized polyethylene terephthalate.

37. A photohardenable electrostatic master according to claim 1 wherein binder (1) is polymethylmethacrylate, ethylenically unsaturated compound (2) is ethoxylated trimethylol propane triacrylate, photoinitiator (3) is 2,2',4,4'-tetrakis(o-chlorophenyl)-5,5'-bis(m,p-dimethoxyphenyl)biimidazole, compound (4) is tris-(p-diethylamino-o-tolyl)methane and acid (5) is p-toluenesulfonic acid.

38. A photohardenable electrostatic master according to claim 37 wherein a chain transfer agent is present.

39. A photohardenable electrostatic master according to claim 38 wherein the chain transfer agent is 2-mercaptobenzoxazole.

40. A photohardenable electrostatic master according to claim 37 wherein the chain transfer agent is 2-mercaptobenzimidazole.

41. A photohardenable electrostatic master according to claim 36 wherein a protective release layer is present on the photohardenable layer.

42. A photohardenable electrostatic layer according to claim 41 wherein the release layer is polyethylene or polypropylene.

43. A photohardenable electrostatic master according to claim 1 imagewise exposed to actinic radiation and electrostatically charged, and toned in the charged areas by means of an electrostatic liquid developer.

44. A photohardenable electrostatic master according to claim 43 wherein the electrostatically charged areas of the master are charged by corona discharge.

45. A photohardenable master according to claim 43 wherein the electrostatically charged areas of the master are toned with an electrostatic liquid developer.

46. A photohardenable master according to claim 45 wherein the electrostatic liquid developer comprises a nonpolar liquid having a Kauri-butanol value of less than 30, a thermoplastic resin having an average particle size of less than 10 μm, and a nonpolar liquid soluble ionic or zwitterionic compound.

47. A photohardenable master according to claim 46 wherein the electrostatic liquid developer contains a colorant.

* * * * *